United States Patent [19]

Betz et al.

[11] Patent Number: 4,717,537

[45] Date of Patent: Jan. 5, 1988

[54] PROCESS FOR MAKING METALLIC ALLOYS USING PRECARBURIZED FERROALLOYS

[75] Inventors: Eurico W. Betz, Araxa; Cyro Takano, Sao Paulo, both of Brazil

[73] Assignee: Companhia Brasileira de Metalurgia e Mineracao, Sao Paulo, Brazil

[21] Appl. No.: 894,348

[22] Filed: Aug. 7, 1986

[30] Foreign Application Priority Data

Aug. 7, 1985 [BR] Brazil ..... 8503727

[51] Int. Cl.[4] ..... B22F 1/00

[52] U.S. Cl. ..... 420/129; 75/251; 75/255

[58] Field of Search ..... 420/129; 419/30, 31; 75/251, 255

[56] References Cited

U.S. PATENT DOCUMENTS 1,975,310 10/1934 Comstock ..... 420/129

FOREIGN PATENT DOCUMENTS 1069561 5/1967 United Kingdom .

1141538 1/1969 United Kingdom .

*Primary Examiner*—Peter D. Rosenberg

*Attorney, Agent, or Firm*—Buchanan Ingersoll

[57] ABSTRACT

A process for forming a metallic alloy having improved material strength and resistance to wear and impact includes precarburizing master alloys to form fine metallic carbides dispersed in a metallic matrix. The metallic carbides are added as precarburized master alloys to a melt and are dissolved to provide a homogeneous distribution of stable carbide particles in the metallic matrix.

6 Claims, 4 Drawing Figures

PROCESS FOR MAKING METALLIC ALLOYS USING PRECARBURIZED FERROALLOYS

BACKGROUND OF THE INVENTION

1. Field of the Invention

This invention relates to a process for forming metallic alloys having improved material strength and resistance to wear and impact and more particularly to the use of precarburized ferroalloys characterized by fine metallic carbides in a metallic matrix in liquid alloy or steel.

2. Description of the Prior Art

It is well known in the fabrication of cast irons and steels to utilize alloy elements and in particular ferroalloys such as ferrites of niobium, vanadium, molybdenum, titanium, tungsten, chromium and others. These ferroalloys containing carbide and carbonitride forming elements are utilized in small quantities, for example less than 0.5%, in the fabrication of high strength, low alloy steels where the carbon content is low, for example less than 1.0%. The alloy elements are dissolved in the liquid steel resulting in precipitation of carbides and carbonitrides. The precipitation preferably occurs after the solidification. By controlling the grain growth or by precipitation hardening the characteristics of high mechanical strength and toughness are added to the steel.

For the iron base alloys having a carbon content greater than 0.5% and/or alloy elements greater than 0.5% the main function of the alloy elements is to form primary carbides. The alloy elements and the carbon react forming solid carbides which precipitate in the melt. This is desirable in the manufacture of tool steels, high speed steels, heat resistant steels, high carbon steels, high alloy steels and in cast irons. However, the conventional ferroalloys tend to form coarse carbides which impair the alloy properties and specifically the material strength to resist impact. The formation of coarse carbides has been a problem in steel and cast iron making and has overall limited the use of higher amounts of carbide forming alloying elements to achieve the desired properties.

One known solution to the problem of formation of coarse carbides has been the addition of particles or agglomerates of pure, fine powder carbides or powders obtained by other processes. However, this solution is considered economically undesirable.

It is also known in the manufacture of welding electrodes for hard facing to utilize carbides of niobium, vanadium, titanium, tungsten, chromium, molybdenum, and other elements to provide the desired degree of hardness and wear strength. These metals are normally added to the electrodes as ferroalloys. During the deposition, however, a substantial loss of these carbide forming elements is encountered. In the case of titanium the loss approaches 90% and in the case of chromium the loss approaches 25%. Overall the recovery yield of these elements as carbides in the coated material is known to be very low. The process of coating by melting is a high fusion speed one therefore even with an excess of carbon in the electrode, there is insufficient time for complete formation of the carbides. The addition of pure carbides by other processes is considered uneconomical.

In the production of high speed steels and special alloys by powder metallurgy where it is difficult to obtain the desired compositions by melting, use of carbides is known. In these applications the various metallic components are mixed, pressed and sintered until the desired degree of density is reached. To achieve the desired degree of hardness and material strength to resist wear, as in the case of steels, carbides of niobium, vanadium, tantalum, titanium, tungsten, molybdenum, chromium and others are added.

While it is known to utilize ferroalloys containing carbide and carbonitride forming elements in the fabrication of tool steels and other alloy steels, there is a need to achieve increased hardness and wear resistance by the addition of increased amounts of alloy carbides without forming coarse carbides.

SUMMARY OF THE INVENTION

In accordance with the present invention there is provided a process for forming a metallic alloy having improved material strength and resistance to wear and impact comprising the steps of precarburizing master alloys containing elements selected from the group of elements consisting of niobium, titanium, vanadium, molybdenum, tungsten, hafnium, chromium, tantalum, and zirconium to form five metallic carbides in a metallic matrix. The precarburized master alloys dissolve in the melt to provide a homogeneous distribution of stable carbide particles in the metallic matrix.

Precarburized master alloys in the form of ferroalloys selected from the group consisting of FeNbC, FeVC, FeTic, FeCrC, FeWC, FeMoC, FeTaC, FeZrC, and FeHfC when added during the alloy melting provide improved strength to resist impact and wear particularly for powder production. The precarburized ferroalloys can be used as an addition before atomization. Principally the precarburized master alloys serve as a substitute to the costly pure metallic carbides and the composition of powder compounds for sintering.

Additionally in the manufacture of welding electrodes the precarburized master alloys and in particular the precarburized ferroalloys when added with the other constituents form an electrode flux having an increased percentage of metallic carbide with high yield of recovery.

Accordingly the principal object of the present invention is to provide a process for using precarburized metal alloys in a furnace or ladle containing a melt or in the production of welding electrodes or in powder metallurgy to obtain a uniform distribution of fine metallic carbides in a metallic matrix.

A further object of the present invention is to provide a process for utilizing precarburized ferroalloys in the production of metallic materials which require a uniform distribution of carbides in a metallic matrix for increased hardness and resistance to the adverse effects of wear, abrasion and impact.

These and other objects of the present invention will be more completely disclosed and described in the following specification, the accompanying drawings, and the appended claims.

DESCRIPTION OF THE PREFERRED EMBODIMENT

Figure 1:
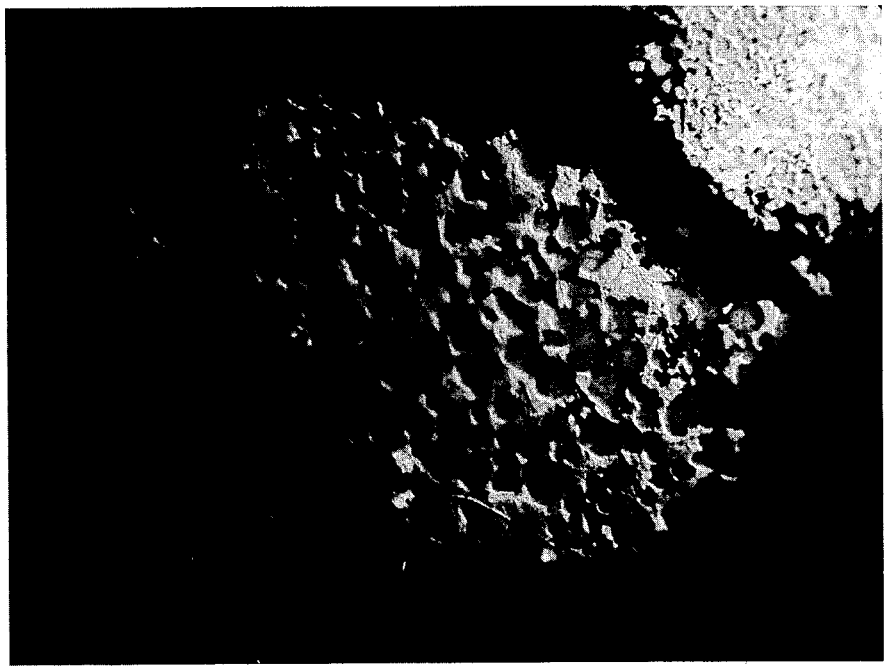
FIG. 1 is micrograph of carburized ferro-niobium (FeNbC).

Referring to the drawings and in particular to FIG. 1 there is illustrated a micrograph of carburized ferro-niobium showing fine particles of niobium carbide (NbC) in a continuous iron matrix. Upon the adding of precarburized ferroalloy, such as ferro niobium carbide, to melted steels and cast irons the ferrite matrix dissolves to release fine particles of stable carbides in the liquid melt. The stable carbide particles are homogeneously distributed throughout the metallic matrix. In accordance with the present invention welding electrodes are formed by mixing precarburized master alloys with other constituents which normally form the electrode flux which covers the electrode wire. The electrodes prepared in this manner are deposited by known techniques onto metallic surfaces normally for hard facing. Further in accordance with the present invention in powder metallurgy precarburized master alloys after grinding substitute the pure metallic carbides utilized in the mixture to be sintered. In the metalizing process the precarburized master alloys after grinding substitute the metallic carbide powders.

Figure 2:
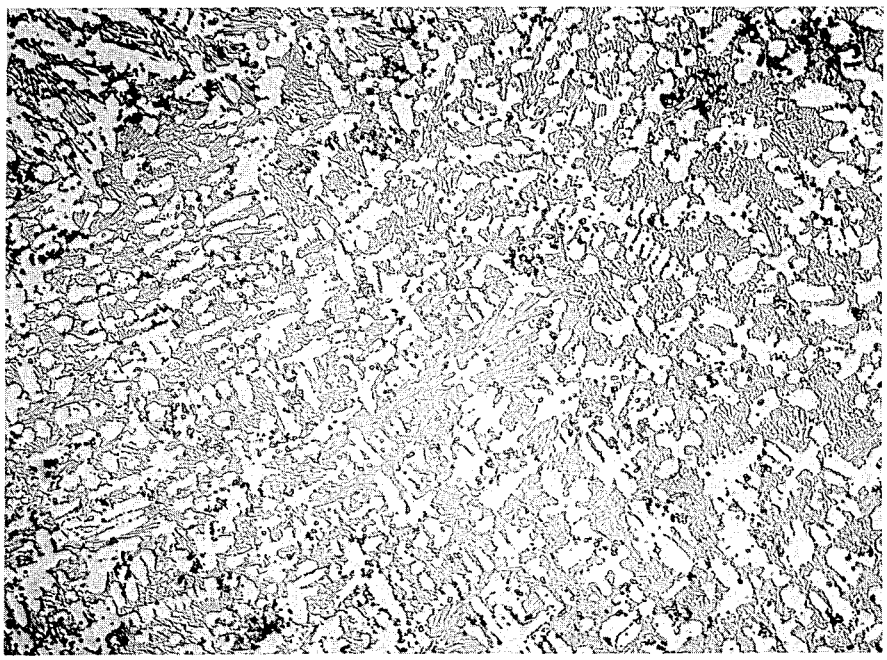
FIG. 2 is a micrograph of white cast iron where carburized ferro-niobium was added.

In FIG. 1 the carburized ferro-niobium is shown in a continuous iron matrix. In the micrograph of FIG. 2 white cast iron (18% by weight chromium and 2.8% by weight carbon) includes 6% by weight niobium carbide added as a carburized ferro-niobium. The very fine niobium carbide particles are homogeneously distributed throughout the metallic matrix.

Figure 3:
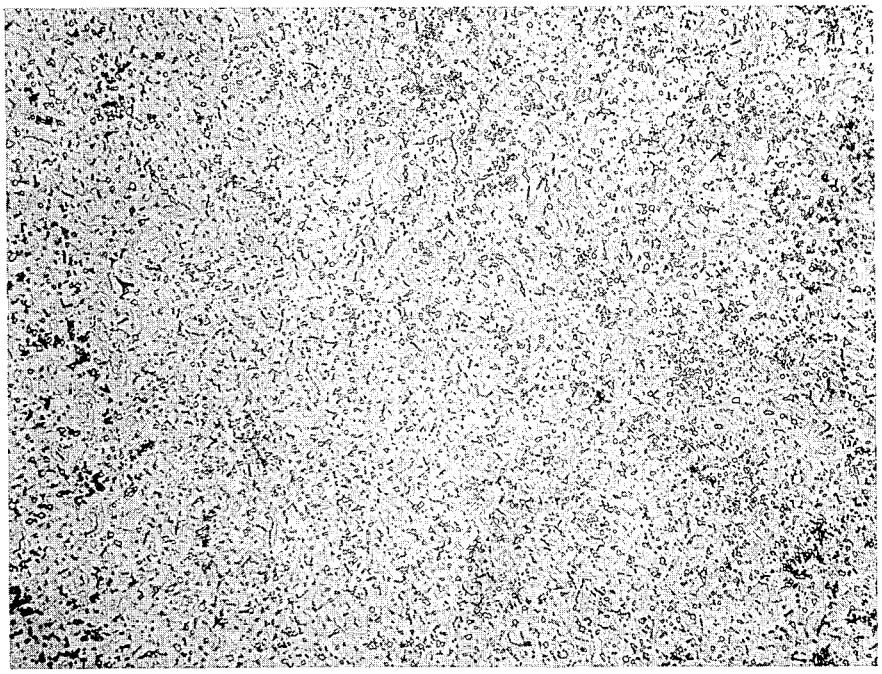
FIG. 3 is a micrograph of a high speed steel where carburized ferro-niobium was added.

Referring to FIG. 3 there is illustrated a micrograph of high speed steel containing 6% by weight niobium carbide. The niobium carbide is added as carburized ferro-niobium in fine particle form. The carburized ferro-niobium particles dissolve in the melt to liberate stable niobium carbide which are homogeneously distributed throughout the metallic matrix. In the case of a coating of metallic hard facing alloy containing niobium carbide shown in FIG. 4, niobium carbide is added as precarburized ferro-niobium to other constituents to form the electrode flux. As shown, fine particles of niobium carbide are shown homogeneously disbursed throughout the metallic matrix.

EXAMPLE 1

Cast iron is made with constituents including 18% by weight chrome, 2.8% by weight carbon, and 6% by weight niobium carbide. The niobium is precarburized by known methods and is added as a carburized ferro-niobium, containing 65% by weight NbC. FIG. 1 illustrates this microstructure. The niobium carbide can be added as carburized ferro-niobium by an inoculation process or by dissolution in a furnace. The cast material thus formed possesses a high recovery of niobium, higher than 85%. The fine carbides are distributed mainly between dendrite arms and some inside the austenite grains. The microstructure as shown in FIG. 2 includes small and well disbursed particles obtained in accordance with the present process. This contrasts with the larger size of the carbides obtained by addition of ferro-niobium.

EXAMPLE 2

A high speed steel composes by weight 0.7% carbon, 3% molybdenum, 3% tungsten, 1% vanadium, and 4% chromium as made in an induction furnace. Carburized ferro-niobium, as shown in FIG. 1, contains 65% by weight NbC was added to a melt in a ladle and in a furnace to reach 3% to 8% by weight NbC. In both cases fine particles of niobium carbide was disbursed throughout, as shown in FIG. 3, to provide a product having superior qualities for tool cutting.

EXAMPLE 3

Figure 4:
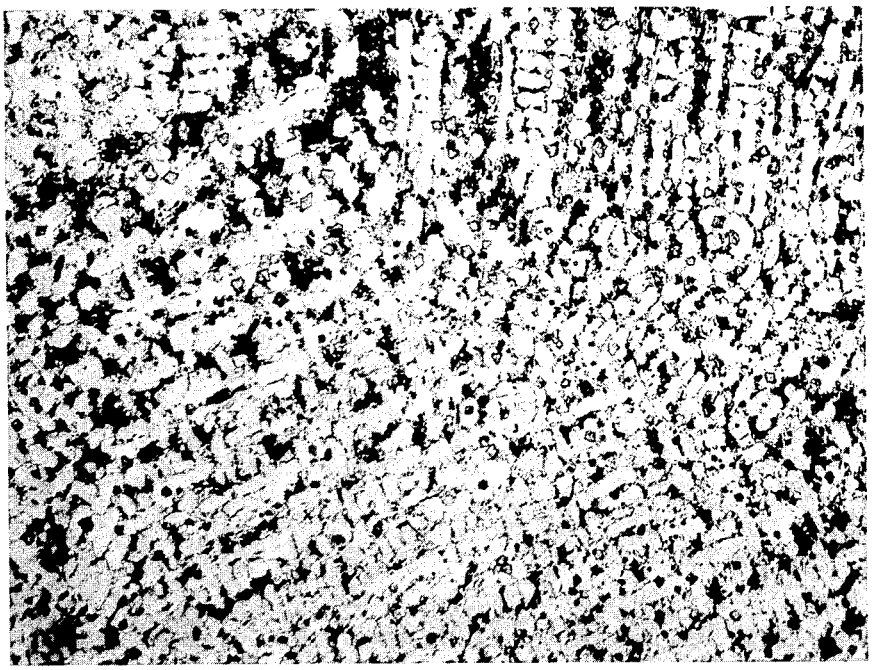
FIG. 4 is a micrograph of a coating of metallic hard facing alloy where carburized ferro-niobium was added in the electrode.

Precarburized FeNb was prepared in an amount by weight of 1% to 30% containing 65% by weight NbC and mixed with other constituents to produce hard facing welding electrodes. The welded material was found to contain a high recovery of niobium, greater than 85%. Fine, stable carbide particles were uniformly and densely distributed throughout the metallic matrix as shown in FIG. 4.

According to the provisions of the patent statutes, we have explained the principle, preferred construction, and mode of operation of our invention and have illustrated and described what we now consider to represent its best embodiments. However, we desire to have it understood that, within the scope of the appended claims, the invention may be practiced otherwise than as specifically illustrated and described.

We claim:

1. A process for forming a metallic alloy having improved material strength and resistance to wear and impact comprising the steps of, precarburizing master alloys containing elements selected from the group of elements consisting of niobium, titanium, vanadium, molybdenum, tungsten, hafnium, chromium, tantalum, and zirconium to form a fine dispersion of metallic carbides in a metallic matrix, adding the precarburized master alloys to a liquid melt, dissolving the metallic matrix of the precarburized master alloys in the liquid melt, releasing from the metallic matrix fine particles of stable carbides in the liquid melt, and thereafter forming a homogeneous distribution of the stable carbide particles throughout the metallic matrix.

2. A process as set forth in claim 1 which includes, adding the metallic carbides as carburized ferralloys, and dissolving the carburized ferroalloys in the liquid melt to form a homogeneous distribution of fine particles of metallic carbides in an iron matrix.

3. A process as set forth in claim 2 which includes, adding the precarburized ferroalloys to a melt in a steel making vessel to form a tool steel having improved resistance to wear, heat, and abrasion.

4. A process as set forth in claim 2 which includes, adding the precarburized ferroalloys to electrode wire by deposition on the metallic surface to form a welding electrode having improved material strength and resistance to wear, corrosion, and impact.

5. A process as set forth in claim 1 which includes, forming a powder from the precarburized master alloys, and adding the powder to constituents of a mixture to be sinterized.

6. A powder metallization process comprising the steps of, precarburizing master alloys containing elements selected from the group of elements consisting of niobium, titanium, vanadium, molybdenum, tungsten, hafnium, chromium, tantalum, and zirconium to form fine metallic carbides dispersed in a metallic matrix, grinding the precarburized master alloys to form a powder, and adding the precarburized master alloy powder to a mixture for sintering.

* * * * *